US006508443B1

(12) United States Patent
Andreasson

(10) Patent No.: US 6,508,443 B1
(45) Date of Patent: Jan. 21, 2003

(54) RE-SEALABLE FOOD STORAGE BAG FILLING DEVICE

(76) Inventor: Mark J. Andreasson, 4741 Molina Rd., Molina, FL (US) 32577

( * ) Notice: Subject to any disclaimer, the term of this patent is extended or adjusted under 35 U.S.C. 154(b) by 0 days.

(21) Appl. No.: 10/094,377

(22) Filed: Mar. 8, 2002

(51) Int. Cl.[7] ..... B65B 67/12

(52) U.S. Cl. ..... 248/97; 220/9.4; 248/175; 383/7

(58) Field of Search ..... 248/95, 97, 99, 248/101, 164, 166, 172, 440.1; 108/35; 280/47.34; 220/9.4, 9.3, 908; 383/7, 33

(56) References Cited

U.S. PATENT DOCUMENTS

| | | | | | |
|---|---|---|---|---|---|
| 310,101 | A | | 12/1884 | Wagner | |
| 1,664,059 | A | * | 3/1928 | Cable | 108/118 |
| 2,639,110 | A | | 5/1953 | Nicolas | |
| 3,298,537 | A | * | 1/1967 | Marco | 246/403 |
| 3,598,350 | A | | 8/1971 | Kaufman | |
| 4,322,048 | A | | 3/1982 | Vollman | |
| 4,469,300 | A | | 9/1984 | Valesko | |
| 4,613,104 | A | * | 9/1986 | Garrott | 248/175 |
| 4,953,815 | A | * | 9/1990 | Beymer et al. | 248/97 |
| 4,989,749 | A | * | 2/1991 | Choi | 220/9.4 |
| 5,183,009 | A | * | 2/1993 | Vito | 119/165 |
| 5,380,081 | A | | 1/1995 | Vogt | |
| 5,507,577 | A | * | 4/1996 | Fowler | 220/9.4 |
| 5,639,050 | A | | 6/1997 | Peterson et al. | |
| 5,772,046 | A | | 6/1998 | Tercher et al. | |
| D423,823 | S | | 5/2000 | Nelson | |

FOREIGN PATENT DOCUMENTS

| | | | |
|---|---|---|---|
| JP | 11-196977 | * | 7/1999 |

* cited by examiner

*Primary Examiner*—Leslie A. Braun
*Assistant Examiner*—Tan Le
(74) *Attorney, Agent, or Firm*—John D. Gugliotta

(57) ABSTRACT

An apparatus is provided to aid in the filling of re-sealable food storage bags is provided. A dual "X" type frame is adjustable by means of a locking screw at the crossing joint. The four outer edges of the "X" are connected together with a series of four rods. On the two upper rods, a series of four clips, (two per rod) are provided.

6 Claims, 4 Drawing Sheets

RE-SEALABLE FOOD STORAGE BAG FILLING DEVICE

RELATED APPLICATIONS

The present invention was first described in Disclosure Document Registration 491,177 filed on Mar. 29, 2001 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to re-sealable plastic kitchen bags and, more particularly, to an expandable, foldable device for holding food storage bags during the filling thereof.

2. Description of the Related Art

The introduction and use of the food storage bag with a plastic zipper-like seal in recent times has been a welcome solution to food storage problems. The ability to completely seal out air from the food storage bag has permitted increased storage times and greater food freshness when compared to other food storage means. As useful as these bags are however, they do have one drawback, in that they are difficult to fill, especially when storing sauces or similar type food products. A person is forced to enlist the help of another to help hold the bag open while filling. This solution however is impractical for those who live alone. Even the manufacturers have begun to address this shortcoming with the recent introduction of flat-bottom storage bags, with a higher cost of course.

A search of the prior art did not disclose any patents that read directly on the claims of the instant invention; however, the following references were considered related.

The following patents disclose a food storage bag holder for supporting the bag in an open position:

U.S. Pat. No. 5,416,834 issued in the name of Bales et al.

U.S. Pat. No. 4,975,941 issued in the name of Morganstein et al.

The following patents describe the design and function of a holding device for sacks or the like to keep them open:

U.S. Pat. No. 5,380,081 issued in the name of Vogt

U.S. Pat. No. 4,469,300 issued in the name of Valesko

U.S. Pat. No. 4,322,048 issued in the name of Vollman

U.S. Pat. No. 3,598,350 issued in the name of Kaufman

U.S. Pat. No. 2,639,110 issued in the name of Nicolas

U.S. Pat. No. 310,101 issued in the name of Wagner

U.S. Pat. No. D 423,823 issued in the name of Nelson

Consequently, a there exists a need for a means by which zipper type food storage bags can be filled by one person in a manner that is quick, easy and efficient.

SUMMARY OF THE INVENTION

It is therefore an object of the present invention to provide an improved It is a feature of the present invention to include the extendable length and expandable width combined with the way in which the device folds for easy storage.

Briefly described according to one embodiment of the present invention, an apparatus to aid in the filling of re-sealable food storage bags is provided. The invention consists of a dual "X" type frame that is adjustable by means of a locking screw at the crossing joint. The four outer edges of the "X" are connected together with a series of four rods.

On the two upper rods, a series of four clips, (two per rod) are provided. To use the invention, the user first adjusts the invention for the width of the bag by the center crossing "X" adjustment knob. Next, the user adjusts the invention for the height of the bag by use of adjustment knobs that allow the two upper connecting rods to slide up and down in a slot. Finally, the user adjusts the invention for the depth of the bag by sliding the adjustment clips back and forth on the upper rod. With the opening of the bag clipped into the invention, the user simply fills the bag with food, sauces, liquids or the like. When finished, the user closes, or "zips" the bag shut from one end, while removing clips as they go.

The use of the present invention allows for one-person filling of food storage bags in a manner which is not only safe, easy and effective, but non-messy as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
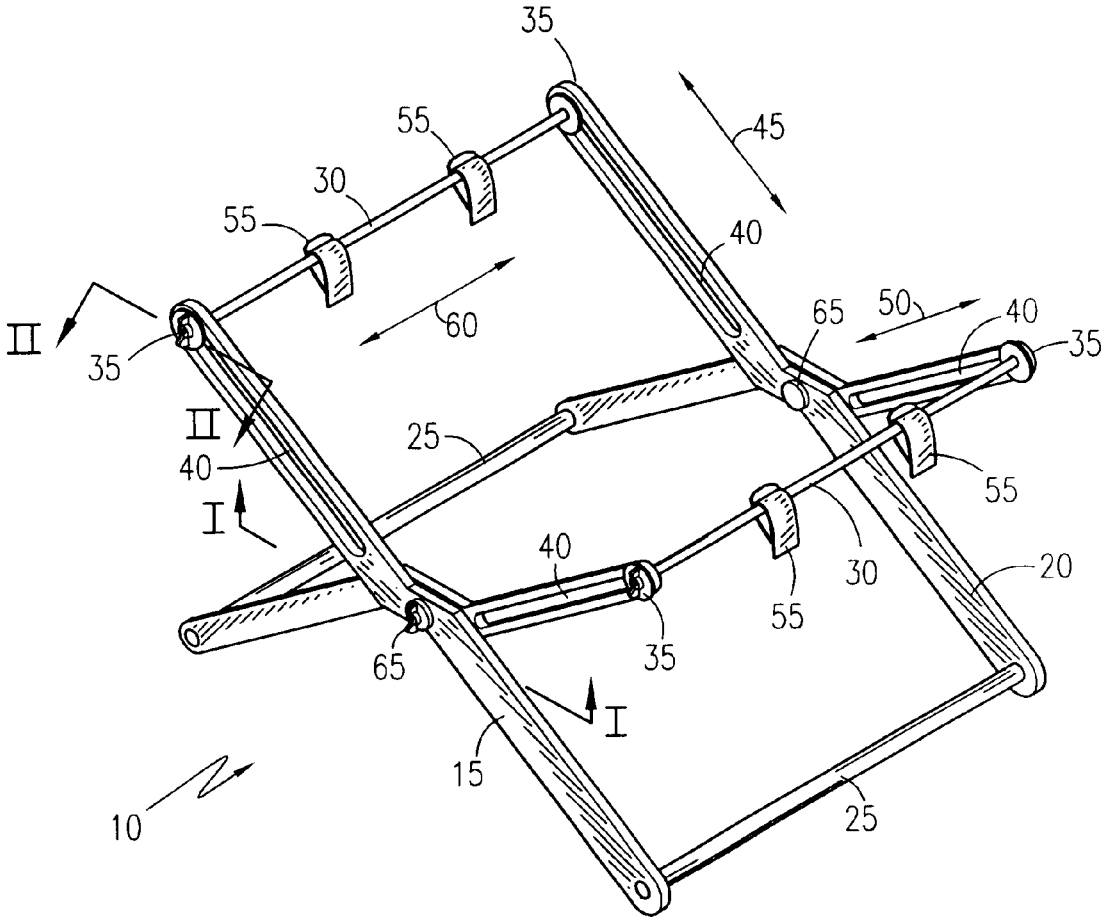
FIG. 1 is an isometric view of a re-sealable food storage bag filling device shown in an open state according to the preferred embodiment of the present invention.

Referring now to FIG. 1, a re-sealable food storage bag filling device 10 is shown in a utilized state, according to the preferred present invention. All components of the invention may be made of steel, plastic, nylon, or similar material, or a combination thereof. The main supporting structure of the invention is formed by a first "X"-shaped support stand 15 and a second "X"-shaped support stand 20, which stand in a vertical position, directly fore and aft, respectively. The furthest members of each arm on the first "X"-shaped support stand 15 and the second "X"-shaped support stand 20 are joined together by a pair of fixed connecting rods 25 on the bottom and a pair of adjustable connecting rods 30 on the top. The fixed connecting rods 25 are held to the first "X"-shaped support stand 15 and the second "X"-shaped support stand 20 by a mechanical fastening method such as adhesive, press-fitting or the like, depending on the material of construction. The adjustable connecting rods 30 are held to the first "X"-shaped support stand 15 and the second "X"-shaped support stand 20 by a series of sliding adjustment knobs 35 which will be described in greater detail herein below. The sliding adjustment knobs 35 thus allows each adjustable connecting rods 30 to slide up and down in a slot 40 which is provided in both the first "X"-shaped support stand 15 and the second "X"-shaped support stand 20. This path of travel is indicated by a first travel path 45 and a second travel path 50 which operate independent of one another. On each adjustable connecting rod 30, there is a pair of spring operated bag clips 55 provided which are permitted to slide along the cylindrical shape of the adjustable connecting rods 30 as depicted by a third travel path 60, of which only one of two is shown for sake of clarity. At the crossover point of the first "X"-shaped support stand 15 and the second "X"-shaped support stand 20, a clamping adjustment knob 65 is provided. The clamping adjustment knob 65 provides for a width adjustment of the re-sealable food storage bag filling device 10 to accommodate various size storage bags as will be shown herein below, as well as to collapse the re-sealable food storage bag filling device 10 for storage. In the fully open position, the adjustable connecting rods 30 as well as the fixed connecting rods 25 are furthest apart from one another and capable of receiving the largest storage bag. In their closed position, the adjustable connecting rods 30 and the fixed connecting rods 25 are in close proximity, so as to be almost touching one another.

Figure 2:
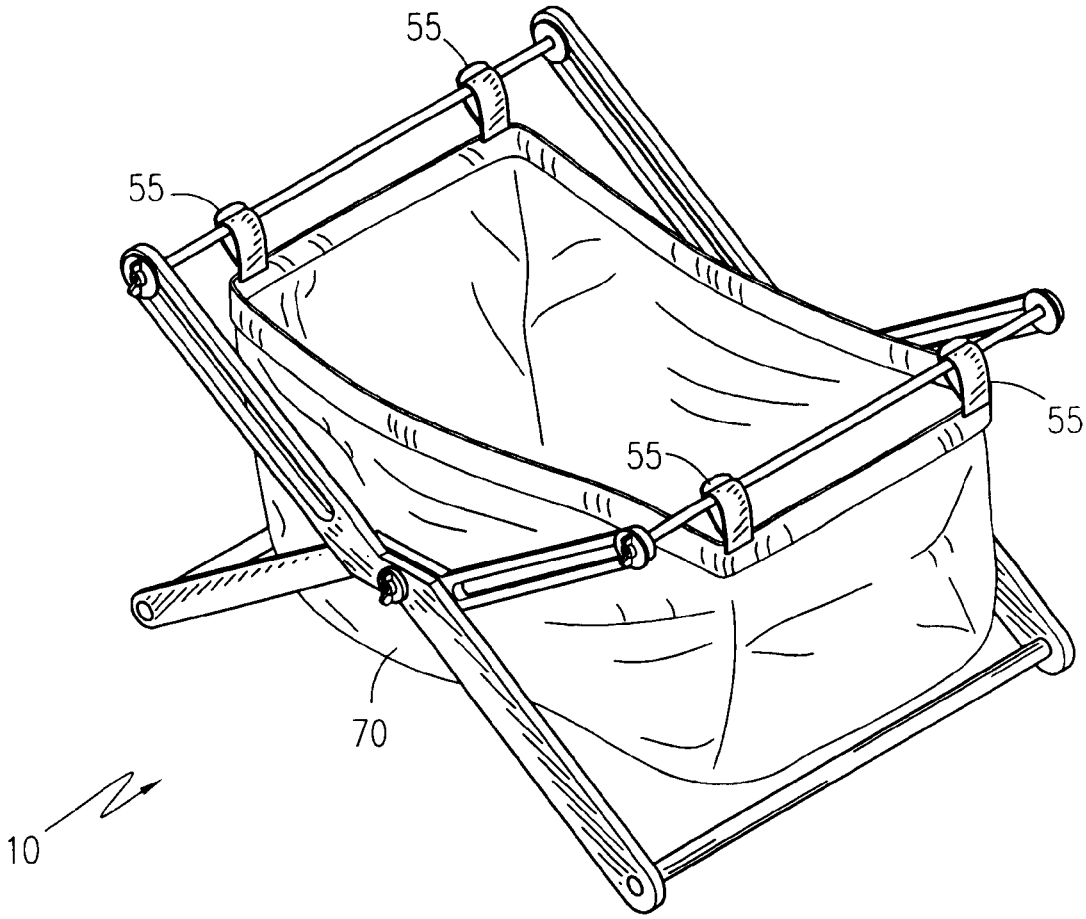
FIG. 2 is an isometric view of a re-sealable food storage bag filling device shown in a utilize state.

Referring next to FIG. 2, a re-sealable food storage bag 70 is located on the interior of the re-sealable food storage bag filling device 10 and is shown in an upright and open manner. The re-sealable food storage bag 70 is envisioned to be of the type with a continuous joining strip or "zipper" along its opening, though it can be seen that virtually any type of food storage bag could be used with equal effectiveness. The re-sealable food storage bag 70 is held open by the four spring operated bag clips 55 in such a stance as to allow food items such as sauces, vegetables, pasta, fruit and the like as well as virtually any item commonly stored in plastic bags to be used. The spring operated bag clips 55 form no permanent degradation of the re-sealable food storage bag 70 and thus allow it to be used over and over again.

Figure 3:
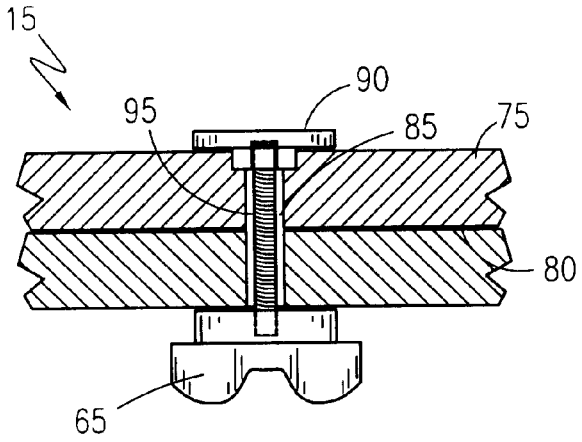
FIG. 3 is a sectional view taken along a line I—I as seen in FIG. 1.

Referring next to FIG. 3, a sectional view, as seen along a line I—I as seen in FIG. 1, is depicted. This FIG., depicts the first "X"-shaped support stand 15 in partial view, and is directly applicable to the second "X"-shaped support stand 20 utilizing a mirror reference. The first "X"-shaped support stand 15 is comprised of a first arm 75 and a second arm 80, which are in close sliding contact with one another around a rotational center point defined by locking shaft 85. The locking shaft 85 is provided with a retaining cap 90 in much the same manner as a conventional screw. The locking shaft 85 is provided with an outer covering of threads, which extend through a hole 95 in both the first arm 75 and the second arm 80. The clamping adjustment knob 65 then engages these threads, and with a rotational action of the clamping adjustment knob 65, thus allows for the securement of the first arm 75 and the second arm 80 in a fixed position, which can be adjusted at a later point by simply reversing the rotational action of the clamping adjustment knob 65. Such action would be performed on both clamping adjustment knob 65 on the first "X"-shaped support stand 15 and the second "X"-shaped support stand 20 (as shown in FIG. 1) in an identical manner, to provide for symmetry of the re-sealable food storage bag filling device 10 (as shown in FIG. 1)

Figure 4:
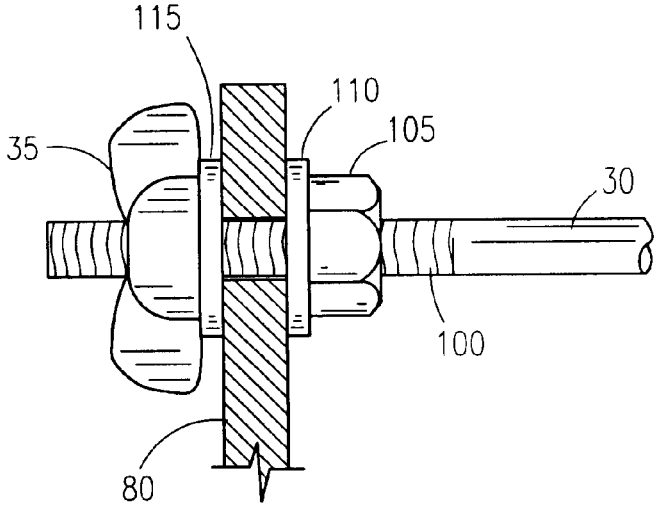
FIG. 4 is a sectional view taken along a line II—II as seen in FIG. 1.

Referring now to FIG. 4, a sectional view as seen along a line II—II as seen in FIG. 2 is depicted. The end of the sliding adjustment knobs 35 is provided with exterior threads 100 which engages an interior locking nut 105. An interior washer 110 is provided next on the sliding adjustment knobs 35, next to the interior locking nut 105 to increase contact surface area and associated friction with the second arm 80. On the opposite side of the second arm 80, an exterior washer 115 and the sliding adjustment knobs 35 is provided. This arrangement allows placement adjustment of the sliding adjustment knobs 35 anywhere along the slot 40 (not shown in this FIG.) of the second arm 80, by a simple rotational loosening of the sliding adjustment knobs 35 and the subsequent sliding of the sliding adjustment knobs 35 to an infinitely variable position. When said position is reached, the sliding adjustment knobs 35 is simply tightened in a conventional matter to hold the sliding adjustment knobs 35 in position by a friction fit. Such action would be performed on all four sliding adjustment knobs 35 as shown in FIG. 1.

Figure 5:
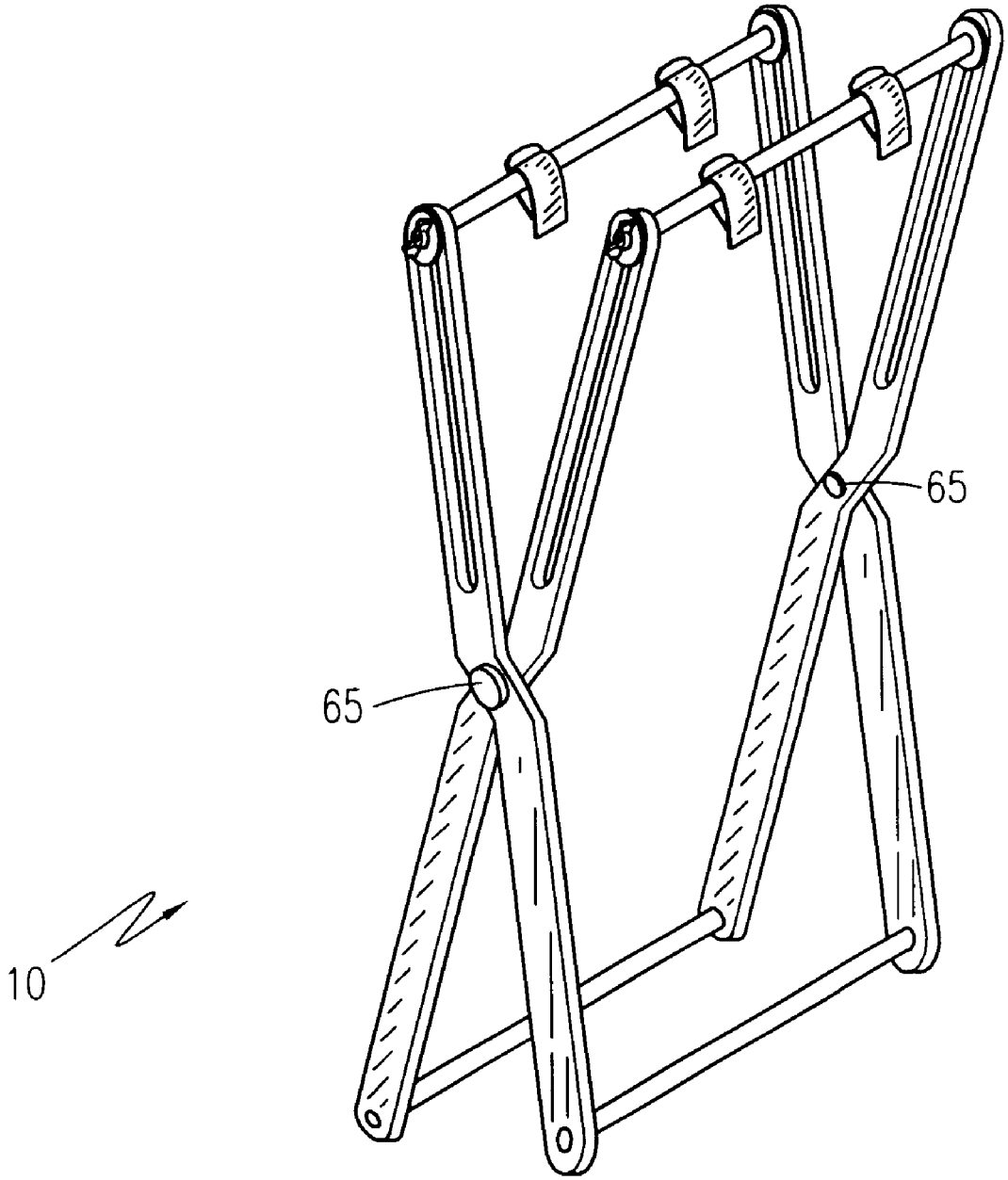
FIG. 5 is an isometric view of the re-sealable food storage bag filling device shown in a collapsed state for storage.

Referring finally to FIG. 5, an isomeric view of the re-sealable food storage bag filling device 10 shown in a collapsed state for storage is shown. Such a depicted state would be used when storing the re-sealable food storage bag filling device 10 in a kitchen cabinet or drawer. It would also be useful when transporting the re-sealable food storage bag filling device 10 from one location to another such as to and from a work site or harvest area on a farm or where canning was being done. The collapsed state of the re-sealable food storage bag filling device 10 is obtained by loosening both clamping adjustment knob 65 and allowing the first "X"-shaped support stand 15 and second, "X"-shaped support stand 20 to collapse on itself in a scissor-like fashion.

2. Operation of the Preferred Embodiment

The present invention is designed with ease of operation features in mind that allow it to be setup and utilized by a common individual with little or no training. To use the present invention, the user simply clips the re-sealable food storage bag 70 into the re-sealable food storage bag filling device 10 using the four spring operated bag clips 55. The re-sealable food storage bag 70 is then opened or spread to the desired position, followed by the action of locking the two clamping adjustment knob 65, thus setting the opening width. The user then adjusts the re-sealable food storage bag filling device 10 to the desired height by using the four sliding adjustment knobs 35 to adjust the placement of the two adjustable connecting rods 30. At this point the user is ready to begin filling the re-sealable food storage bag 70 with the desired contents such as food or other material.

When filled, the process is reversed, by first loosening the two clamping adjustment knob 65 and closing the re-sealable food storage bag filling device 10 in a scissor-like manner. The user may then systematically remove the four spring operated bag clips 55 while closing or "zipping" the bag close. Portions of the bag that are not yet closed, would be held together by the re-sealable food storage bag filling device 10 thus yielding additional assistance to the user.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A re-sealable food storage bag filling device comprising:

a main supporting structure formed by a first "X"-shaped support stand and a second "X"-shaped support stand, both said support stands being in a vertical position, directly fore and aft, respectively, having a furthest members of each arm on the first "X"-shaped support stand and the second "X"-shaped support stand being joined together by a pair of fixed connecting rods on a bottom and a pair of adjustable connecting rods on the top; and mechanical fastening means for fixing said connecting rods to said first "X"-shaped support stand and said second "X"-shaped support stand; wherein said adjustable connecting rods are held to said first "X"-shaped support stand and said second "X"-shaped support stand by a series of sliding adjustment knobs, wherein said sliding adjustment knobs allow each adjustable connecting rods to slide up and down in a slot which is provided in both said first "X"-shaped support stand and said second "X"-shaped support stand.

2. The re-sealable food storage bag filling device of claim 1, wherein each adjustable connecting rod further comprises a pair of spring operated bag clips for permitting said adjustment knobs to slide along the cylindrical shape of said adjustable connecting rods such that a clamping adjustment knob thereby provides for a width adjustment of the re-sealable food storage bag filling device to accommodate various size storage bags as well as to collapse the re-sealable food storage bag filling device for storage.

3. The re-sealable food storage bag filling device of claim 2, wherein said a re-sealable food storage bag is held open by the four spring operated bag clips in such a stance as to allow food items to be stored therein.

4. The re-sealable food storage bag filling device of Claim 1, wherein said first "X"-shaped support stand is comprised of a first arm and a second arm in close sliding contact with one another around a rotational center point defined by locking shaft.

5. The re-sealable food storage bag filling device of claim 4, wherein said locking shaft is provided with a retaining cap and an outer covering of threads, which extend through a hole in both the first arm and the second arm.

6. The re-sealable food storage bag filling device of claim 1, wherein said mechanical fastening means is selected from the group comprising: adhesive; fasteners; and press-fitting mechanical impingement.

* * * * *